252-99 AU 166 EX
3/28/78 XR 4,081,396

United States Patent [19]
Batterton
[11] 4,081,396
[45] Mar. 28, 1978

[54] METHOD OF CLEANING

[76] Inventor: Thomas E. Batterton, 25 Pine St., Princeton, N.J. 08540

[21] Appl. No.: 647,322

[22] Filed: Jan. 7, 1976

[51] Int. Cl.² ..... C11D 3/48

[52] U.S. Cl. ..... 252/106; 252/99; 252/109; 134/2; 134/3; 424/51; 424/128; 424/150

[58] Field of Search ..... 252/106, 109, 99; 424/51, 150, 128; 134/2, 3

[56] References Cited

U.S. PATENT DOCUMENTS

| | | | |
|---|---|---|---|
| 1,557,266 | 10/1925 | Moore | 252/106 X |
| 2,904,470 | 9/1959 | Berliner et al. | 252/106 X |
| 2,931,777 | 4/1960 | Shelanski et al. | 252/106 |
| 3,028,301 | 4/1962 | Winicou | 252/106 X |
| 3,150,096 | 9/1964 | Schmidt et al. | 252/106 |
| 3,338,837 | 8/1967 | Hodes | 252/106 |
| 3,524,912 | 8/1970 | Withycombe | 424/150 |
| 3,658,711 | 4/1972 | Mukai et al. | 252/156 X |

*Primary Examiner*—Mayer Weinblatt

[57] ABSTRACT

A cleaning composition is disclosed which is especially suitable for cleaning beer tubes or lines and comprises an alkali metal-phosphorous salt, tincture of iodine and water. The cleaning composition is conveniently packaged in a dispensing container such as an aerosol container for injection into beer lines such as those employed in the tapping of a beer keg.

1 Claim, No Drawings

METHOD OF CLEANING

SUMMARY OF THE INVENTION

The present invention relates to a cleaning composition comprising a water soluble alkali metal-phosphorous salt such as trisodium phosphate, tincture of iodine and water. The tincture of iodine is made up from a mixture of iodine, an alkali metal iodide such as potassium iodide, water and a lower molecular weight water soluble alcohol such as methanol.

Beer lines may be cleaned by contacting the interior of such lines with the foregoing composition. In another aspect of the invention, the foregoing composition is prepared in a dispensing container such as an aerosol package comprising a valved container having the aforementioned composition and a propellant gas therein. The various propellant gases that may be employed include the halogenated hydrocarbons such as the fluorocarbons, compressed air or compressed carbon dioxide and the art known equivalents thereof.

DETAILED DESCRIPTION

Beer served on draft is obtained from a keg by means of a line leading from the keg to a tap or valve, the line being coiled to act as a heat exchanger and immersed in a cooling medium such as refrigerated air or ice. the beer is forced out of the key through the line and up to the tap by the application of air pressure over the beer in the keg. The line including the coil leading from the keg to the tap requires cleaning periodically in order to assure a clear flow of beer from the tap. Most establishments having this apparatus are not equipped to clean the line and the coil and have to contract for this service. It would be a great advantage to have means available to perform this cleaning operation and thereby avoid having to contract for outside services for its completion. It would also be desirable to have a cleaning composition that would be able to soak into an accumulation of dirt on the inside of the lines to obviate having to remove this accumulation by means of a brush or other grating tool, especially where the cleaning of a coiled beer line is involved since this section of the line is difficult to reach with a cleaning implement.

It is therefore an object of the present invention to overcome these and other difficulties encountered in the prior art.

It is a further object of the present invention to provide a composition and means for achieving the objects set forth above.

It is also an object of the present invention to provide a novel cleaning composition.

It is an object of the invention to further provide apparatus which may be employed for cleaning lines or conduits that are inaccessible to cleaning implements.

These and other objects have been achieved according to the present invention and will become apparent from the disclosure and claims that follow as well as the appended drawing.

The novel cleaning composition of the present invention comprises from about 2 to about 6 ounces by weight of a water soluble alkali metal phosphorous salt, from about 0.25 to about 1.5 ounces by volume of tincture of iodine and from about 0.25 to about 1.5 quarts of water. The alkali metal may comprise any alkali metal known in the art but especially comprises sodium, potassium and ammonium cations.

The various water soluble alkali metal phosphorous salts may include the hypophosphites ($XH_2PO_2$) the phosphites ($X_2HPO_3$) the hypophosphites ($X_4P_3O_6$), the phosphates ($X_3PO_4$) and the perphosphates ($X_3PO_5$) the symbol "X" in the parenthetical formulas comprising an alkali metal as defined herein.

The foregoing composition is distinguishable from U.S. Pat. No. 3,338,837 Hodes in that a surface active agent is not required for complexing the iodide ion and does not require the interaction of an organic halogen oxidant with an inorganic iodide for the liberation of hypoiodous acid.

The alkali metal phosphorous salt in one embodiment comprises a phosphate such as a sodium phosphate and more particularly trisodium phosphate.

The tincture of iodine comprises a mixture of from about 4 to about 10 grams of iodine, from about 3 to about 7 grams of an alkali metal iodide and from about 3 to about 7 ml. of water, the foregoing mixture being brought up to 100 ml. in volume by the addition thereto of a lower molecular weight water soluble alcohol such as methanol, ethanol and the like.

The alkali metal iodide contains an alkali metal as previously defined.

The foregoing composition may be used to clean beer lines by evacuating the beer lines and injecting the cleaning composition into the beer lines for a period of anywhere from about 5 to about 20 minutes after which the lines may be rinsed and are then ready for use again.

The foregoing composition is easily injected into beer lines as described previously by packaging such composition in an aerosol container that is valved and has a propellant gas therein such as a halocarbon, compressed air or compressed carbon dioxide. The preferred halocarbons comprise fluorocarbons such as fluorocarbon 11 i.e., trichloro monofluoro methane.

The following example is illustrative.

Example 1

A cleaning composition is made up by the addition of 4 ounces by weight of trisodium phosphate, one ounce by volume of a tincture of iodine and one quart of water. The tincture of iodine comprises 7 grams of iodine, 5 grams of potassium iodide, 5 ml. water and the balance methanol, the mixture being brought up to 100 ml. in volume by the addition of methanol.

The foregoing composition is introduced into an evacuated beer line and allowed to soak therein for a period of time from about 15 to about 20 minutes after which it is removed from the line, the line rinsed and readied for use again. By using the composition in the foregoing manner, the line is adequately cleaned so that beer let through the line is clear when poured from the tap whereas when prior to such cleaning, the beer is cloudy.

Although the invention has been described by reference to some embodiments it is not intended that the novel composition, method of cleaning or aerosol package be limited thereby, but that modifications thereof are intended to be included as falling within the broad scope and spirit of the foregoing disclosure, the following claims and the appended drawing.

What is claimed is:

1. A method of cleaning beer lines comprising contacting said beer lines with a composition consisting essentially from about 2 to about 6 ounces by weight of a water soluble alkali metal phosphorous salt selected from a member of the group consisting of the hypophosphites ($XH_2PO_2$) the phosphites ($X_2HPO_3$) the hypophosphites ($X_4P_3O_6$), the phosphates ($X_3PO_4$) and the perphosphates ($X_3PO_5$), the symbol "X" is an alkali metal, from about 0.25 to about 1.5 ounces by volume of tincture of iodine, said tincture of iodine consisting essentially of a mixture of from about 4 to about 10 grams of iodine, from about 3 to about 7 grams of an alkali metal iodide and from about 3 to about 7 ml. of water, said mixture being brought up to 100 ml. in volume by the addition thereto of a lower molecular weight water soluble alcohol selected from a member of the group consisting of methanol and ethanol, and from about 0.25 to about 1.5 quarts of water, said alkali metal being selected from a member of the group consisting of sodium, potassium and ammonium cations.

* * * * *